United States Patent [19]

Asano et al.

[11] 4,394,093

[45] Jul. 19, 1983

[54] SUPPORT MEANS FOR PRINT WIRE

[75] Inventors: Kiyomitsu Asano, Musashino; Masao Jozuka; Toshikatsu Kondo, both of Nagoya, all of Japan

[73] Assignees: Brother Kogyo Kabushiki Kaisha, Nagoya; Nippon Telecommunication Engineering Company, Tokyo, both of Japan

[21] Appl. No.: 290,298

[22] Filed: Aug. 5, 1981

[30] Foreign Application Priority Data

Aug. 12, 1980 [JP] Japan ..... 55-111426

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,136,978 1/1979 Bellinger et al. ..... 400/124

4,248,540 2/1981 Bellinger ..... 400/124

*Primary Examiner*—Paul T. Sewell

*Attorney, Agent, or Firm*—Browdy and Neimark

[57] ABSTRACT

A print head for a serial dot-printer which includes improved structure to fix each print wire to a pivotable armature. The armature is provided with an arm portion which is made of a stainless steel plate and consists of a pair of mutually opposed side portions and a connecting portion connecting the side portions. Inner surfaces of the front areas of the side portions are welded to each other at the free end portion of the arm. A first supporting full 360° aperture is thus formed between the welded side portions perpendicular to the longitudinal direction of the armature, and a second print wire supporting aperture is formed in the connecting portion and is spaced by a predetermined distance from the first supporting aperture. The rear end of the print wire is inserted through the first supporting aperture until it reaches the second supporting aperture where it is welded to the internal surface of the second supporting aperture in the connecting portion.

3 Claims, 4 Drawing Figures

SUPPORT MEANS FOR PRINT WIRE

BACKGROUND OF THE INVENTION

1. Field of the Invention

This invention relates to a serial dot-printer, particularly to a print wire support device for supporting one end of a print wire in a serial dot-printer wherein a plurality of armatures on which a print wire is respectively secured are selectively driven in the longitudinal direction thereof.

2. Prior Art

In conventional printers of this type the fixing end of the print wire is usually fixed on the armature by heat welding, etc., which remarkably degrades the strength of the fixed end of the print wire in comparison to the proper strength of the material of the print wire due to the effect of the heat when welded. The fixed end becomes therefore fairly susceptible, when bending force is directly applied thereto in the course of printing operations, to plastic deformation.

SUMMARY OF THE INVENTION

It is therefore a primary object of this invention, which has been made to eliminate the above-mentioned disadvantage, to provide a print wire support device for a print head of a serial dot-printer, wherein the effect of bending force is avoided not to directly act on the fixed end of the print wire during the printing operation so that the print wire may be surely protected from plastic deformation even when it is placed under the influence of some bending force.

According to this invention there is provided a novel print wire support device for a serial dot-printer. The support device characteristically includes an armature provided with a first supporting aperture and a second supporting aperture located on the axis of the first supporting aperture and backwardly spaced by a predetermined distance therefrom. A rear end portion of the print wire is inserted through the first supporting aperture until it reaches the second supporting aperture to be firmly fixed to the armature by beam welding, etc. Bending force applied on the print wire in the course of printing operations is received by an internal surface of the first supporting aperture and the fixed end of the print wire is effectively protected against plastic deformation.

In a preferred embodiment of this invention the armature is provided with an arm portion consisting of a pair of side portions mutually opposed and a connecting portion connecting the pair of side portions. The side portions are mutually joined by welding at a free end portion of said arm portion and the first supporting aperture is formed in the joined portion wherein the print wire is not welded. The second aperture is formed in the connecting portion.

It is another object of this invention to provide a durable print head for a serial dot-printer.

To attain the object a print head according to the invention is so constructed as to comprise (a) a support member, (b) a plurality of armatures, (c) connecting means pivotally connecting each of the armatures at first end portions thereof to the support member, (d) a first supporting aperture formed at a second end portion of each armature substantially perpendicularly to the longitudinal direction of the armature, (e) a second supporting aperture formed at the second end portion of each armature backwardly spaced by a predetermined distance from the first supporting aperture on the axis thereof, (f) a print wire piercing at the rear end thereof through the first supporting aperture until reaching the second supporting aperture to be firmly fixed to the armature, and (g) drive means disposed respectively corresponding to each of the armatures for selectively driving the armatures to axially advance the print wire.

DETAILED DESCRIPTION OF A PREFERRED EMBODIMENT

Figure 4:
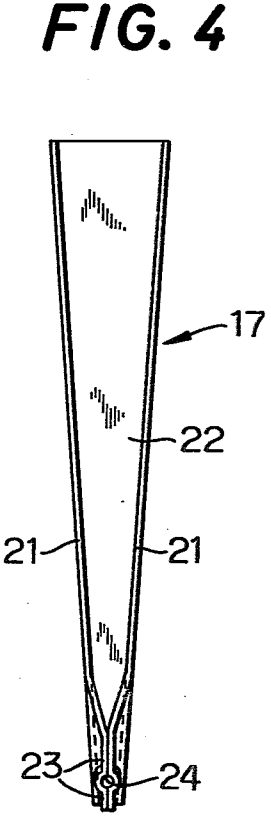
FIG. 4 is an enlarged elevational view of the arm portion of the armature.
Figure 3:
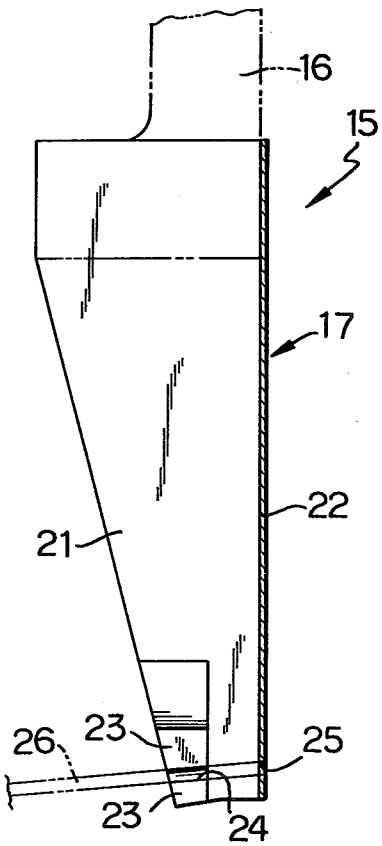
FIG. 3 is an enlarged sectional view of an arm portion of an armature.

An embodiment of the present invention will be described with reference to the drawings illustrating a print head H in which this invention is realized. On a substantially circular plate shaped base member 1 of magnetic material a yoke portion 2 is formed along the external peripheral edge. In the central portion of the base member 1 an opening 3 is formed. On the internal side of the yoke portion 2 a plurality of cores 4 are disposed at regular intervals on one circumference. About each of the core 4 a coil 5 is wound for producing magnetic force when the coil 5 is energized by a printing signal.

On one end surface of the yoke 2 a permanent magnet 6 of annular shape is secured by its own magnetic force, and on one end surface of the permanent magnet 6 an armature support member 7 of annular shape made of magnetic material is similarly secured by the magnetic force of the permanent magnet 6. The yoke portion 2, the cores 4, the coils 5, and the permanent magnet 6 constitute drive means.

A cover member 8 composed of a cover portion 9 of magnetic material and a wire guide portion 10 of synthetic resin is secured on the support member 7 by the magnetic force of the permanent magnet 6. The cover portion 9 and the wire guide portion 10 are mutually fixed to each other by means of a plurality of pins 11 and stop rings 12. On the internal side of the cover portion 9 a plurality of armature receiving notches 13 are formed so as to to face each of the cores 4, respectively. All of the yoke portion 2, the armature support member 7, and the cover member 8 are further firmly fastened to each other by a connecting member 14.

Between the cores 4 and the cover member 8 a plurality of armatures 15 are so disposed as to face the cores 4, respectively. Each armature 15 consists of a magnetic member 16 and an arm portion 17 made of an 18-8 stainless steel plate by a bending process, both being firmly welded together, as with the use of a laser beam. The central portion of the magnetic member 16 is so disposed as to be respectively accommodated in a corresponding armature receiving notch 13. The foot of each magnetic member 16 is pivotally connected to the armature support member 7 by way of connecting means 20 composed of two resilient members. The connecting means 20 comprises a leaf spring 18 connected to the armature support member 7 and having at the central area thereof a perforation 18a and a wire spring 19 which perpendicularly crosses the leaf spring 18 piercing through the perforation 18a, to thereby connect the magnetic member 16 to the armature support member 7, as shown in FIG. 1.

Figure 1:
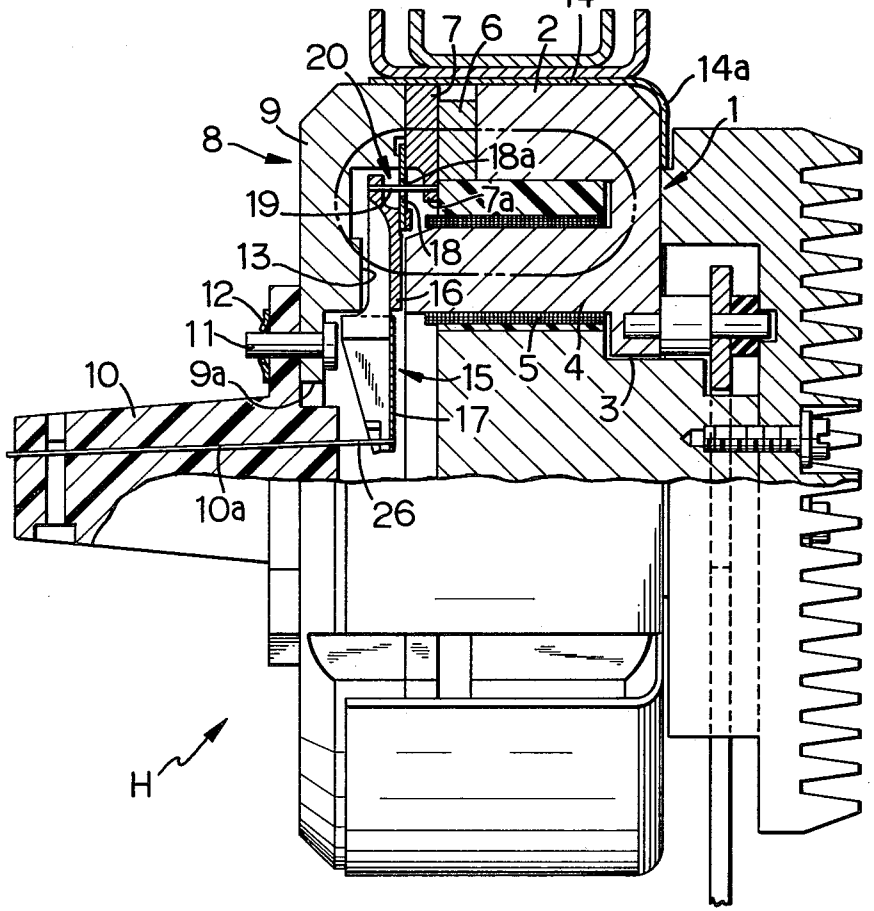
FIG. 1 is a side view, partly broken away, of an embodiment of a print head in which this invention is realized.
Figure 2:
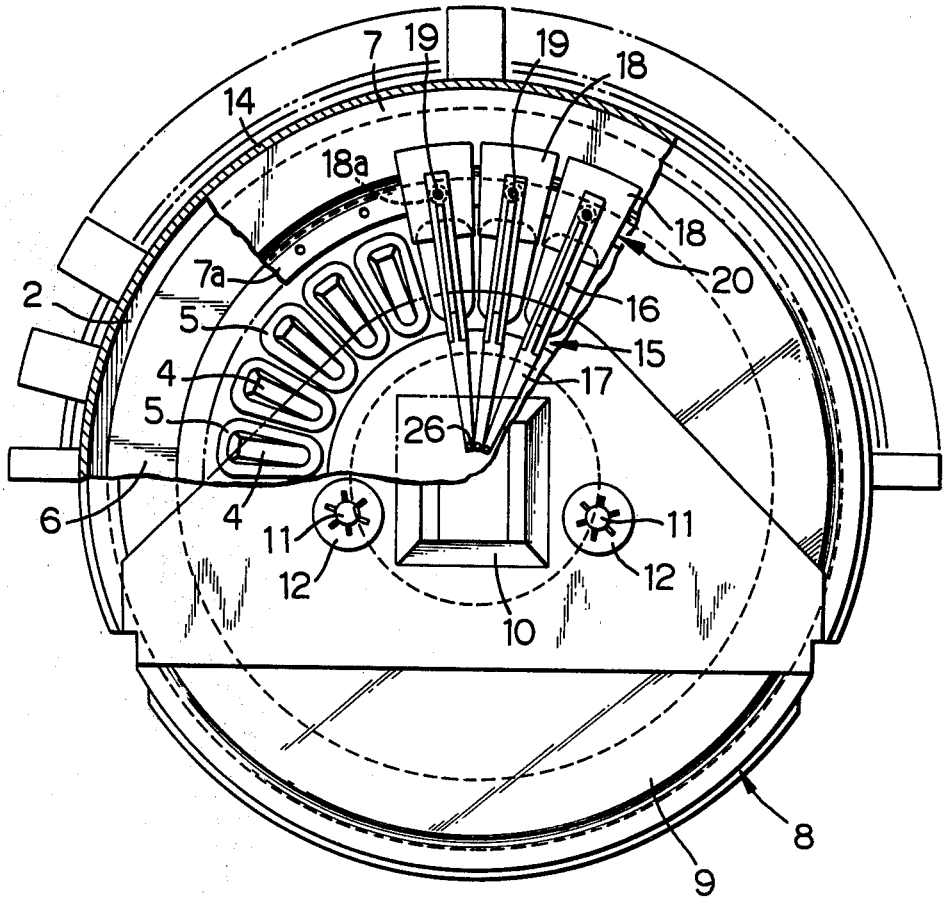
FIG. 2 is an elevational view, partly broken away, of an essential part of the print head.

Normally, the magnetic path passing the magnetic member 16 is formed by the permanent magnet 6 as shown in FIG. 1 with a two-dot-chain line, and the armature 15 is maintained at a non-operative position being attracted to one end surface of the core 4 against the resilient force of the support means 20 by the magnetic force of the permanent magnet 6. When the coil 5 is energized by current conduction, a magnetic flux in a reverse direction to that of the magnetic flux due to the permanent magnet 6 is formed to pivot the armature 15 due to the resilient force of the support means 20 to the printing position shown in FIG. 1.

The arm portion 17 of the armature 15 consists of a pair of facing side portions 21 and a connecting portion 22 connecting the two side portions 21, all FIG. 4. Thus, as shown in FIG. 4, arm structure 17 has a U-shaped cross section, side portions 21 defining the arms of the U, and connecting portion 22 defining the base of the U. The side portions 21 are joined together at the facing inner surfaces thereof by laser beam welding to form a joined together portion 23 at a free end portion of the arm portion 17, and a first supporting aperture 24 is formed at a substantially middle position of the joined portion 23. There is formed in the connecting portion 22 a second aperture 25 which is aligned with the first aperture 24 and spaced therefrom by a predetermined distance along the axis of alignment. This axis is substantially perpendicular to the longitudinal direction of the armature 15. In other words, the joined portion 23 which is spaced from the surface of the connecting portion 22 is made of the free end parts of the side portions 21. As seen in FIG. 4, each of the inner surfaces of the free end parts is formed with a groove of semicircular cross section to define a substantially full 360° cylindrical inner surface which defines the first aperture 24.

A print wire 26 is inserted into a guide bore 10a of the wire guide portion 10 and further through the first supporting aperture 24 until the leading end is located in the second supporting aperture 25. This end is welded, at the aperture 25, to the connecting portion 22, as with the use of a laser beam. Upon pivoting of the armature 15 from the nonoperative position to the printing position, the print wire 26 projects from the wire guide portion 10 to perform a printing operation.

When the coil 5 is energized by a printing signal, the magnetic flux of the permanent magnet passing through the core 4 shown with the two-dot-chain line in FIG. 1 is neutralized so as to separate the armature 15 from the one end surface of the core 4 due to the spring force of the support means 20. The free end of the print wire 26 projects forward from the wire guide portion 10 to perform a printing operation.

When the print wire 26 strikes the printing surface in the course of a printing operation it receives a bending force caused by its buckling due to compressive force formed as a counter-force to striking the printing surface. The bending force is however received by the full 360° internal surface of the first supporting aperture 24, as shown in FIG. 4 without directly effecting the fixed end of the print wire 26 in the neighborhood of the second supporting aperture 25 where the strength of the material may have been deteriorated by the heat of the laser beam welding. This effectively prevents plastic deformation of the fixed end of the print wire 26.

What is claimed is:

1. A print wire support device for a printer wherein a plurality of print wires are selectively driven in a longitudinal direction thereof to perform a printing action, said support device comprising:

an armature including an arm portion carrying each of said print wires, said arm portion being formed of a single planar blank by bending into a structure of a U-shaped cross section having opposite arms and a base, said arm portion having a free end and including a pair of side portions corresponding to the opposite arms of said U-shaped cross section and facing toward each other, free end parts of said side portions being joined at inner surfaces thereof by welding in a plane parallel to said side portions to form a joined portion at said free end part of said arm portion, and a connecting portion corresponding to the base of said U-shaped cross section and connecting said pair of side portions, said joined portion being formed in spaced relation to said connecting portion and having a first supporting aperture formed therethrough substantially perpendicular to said connecting portion, each of said inner surfaces of said parts of the side portions being formed with a groove of semicircular cross section to define a substantially full 360° cylindrical inner surface defining said first supporting aperture when said inner surfaces are welded, said connecting portion having a second supporting aperture formed through the thickness thereof and in alignment with said first supporting aperture along a line substantially perpendicular to said connecting portion, said first and said second supporting apertures being spaced from each other by a predetermined distance along said line of alignment, said print wires each having a fixed end portion welded to a portion of said connecting portion defining said second supporting aperture, and said fixed end portion extending through said first supporting aperture in contact with said substantially full 360° cylindrical inner surface defining said first supporting aperture such that a bending force applied to said print wire upon said printing action is received by said cylindrical inner surface.

2. A print wire support device as recited in claim 1, wherein said armature consists of said arm portion and a magnetic member welded to said arm portion, said arm portion being formed of a stainless steel.

3. A print head adapted to be incorporated in a serial dot-printer, comprising:

a support member;

a plurality of armatures;

connecting means pivotally connecting each of said armatures at one end portion thereof to said support member;

a plurality of print wires corresponding to said plurality of armatures; and drive means disposed in opposition to respective ones of said plurality of armatures for selectively driving the respective armature to axially advance said print wires for a printing action, each of said plurality of armatures including an arm portion remote from said connecting means and carrying each of said print wires, said arm portion being formed of a single planar blank by bending into a structure of a U-shaped cross section having opposite arms and a base, said arm portion having a free end and including a pair of side portions corresponding to the opposite arms of said U-shaped cross section and facing toward each other, free end parts of said side portions being joined at inner surfaces thereof by welding in a plane parallel to said side portions to form a joined portion at said free end part of said arm portion, and a connecting portion corresponding to the base of said U-shaped cross section and connecting said pair of side portions, said joined portion being formed in spaced relation to said connecting portion and having a first supporting aperture formed therethrough substantially perpendicular to said connection portion, each of said inner surfaces of said parts of the side portions being formed with a groove of semicircular cross section to define a substantially full 360° cylindrical inner surface defining said first supporting aperture when said surfaces are welded, said connecting portion having a second supporting aperture formed through the thickness thereof and in alignment with said first supporting aperture along a line substantially perpendicular to said connecting portion, said first and second supporting apertures being spaced from each other by a predetermined distance along said line of alignment, said print wires each having a fixed end portion welded to a portion of said connecting portion defining said second supporting aperture, said fixed end portion extending through said first supporting aperture in contact with said substantially full 360° cylindrical inner surface defining said first supporting aperture such that a bending force applied to said print wire upon said printing action is received by said cylindrical inner surface.

* * * * *